US010779388B2

(12) United States Patent
Jeon

(10) Patent No.: US 10,779,388 B2
(45) Date of Patent: Sep. 15, 2020

(54) EUV GENERATION DEVICE

(71) Applicant: Samsung Electronics Co., Ltd., Suwon-si, Gyeonggi-do (KR)

(72) Inventor: Byeong Hwan Jeon, Hwasung-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 0 days.

(21) Appl. No.: 16/227,080

(22) Filed: Dec. 20, 2018

(65) Prior Publication Data

US 2020/0053860 A1 Feb. 13, 2020

(30) Foreign Application Priority Data

Aug. 8, 2018 (KR) ..... 10-2018-0092377

(51) Int. Cl.
*H05G 2/00* (2006.01)

(52) U.S. Cl.
CPC ..... *H05G 2/003* (2013.01); *H05G 2/008* (2013.01)

(58) Field of Classification Search
CPC ..... H05G 2/003; H05G 2/008
See application file for complete search history.

(56) References Cited

U.S. PATENT DOCUMENTS 9,192,037 B2 11/2015 Ueno
9,334,177 B1 * 5/2016 Niell, III ..... C02F 1/325
9,544,983 B2 1/2017 Rajyaguru et al.
2004/0108473 A1 * 6/2004 Melnychuk ..... B82Y 10/00 250/504 R
2005/0199829 A1 * 9/2005 Partlo ..... B82Y 10/00 250/504 R
2009/0250641 A1 * 10/2009 Moriya ..... G03F 7/70033 250/504 R
2014/0042653 A1 2/2014 Ueno
2015/0076372 A1 * 3/2015 Ziemba ..... H01J 65/048 250/493.1
2015/0097107 A1 4/2015 Lim et al.

FOREIGN PATENT DOCUMENTS

JP 2007-028728 A 2/2007
JP 2007-136777 A 6/2007
KR 101207983 B1 12/2012

* cited by examiner

*Primary Examiner* — Nicole M Ippolito
*Assistant Examiner* — Sean M Luck
(74) *Attorney, Agent, or Firm* — Harness, Dickey and Pierce, P.L.C.

(57) ABSTRACT

An extreme ultraviolet (EUV) generation device includes a housing module including a housing body whose inside is maintained in a vacuum state and an exit window formed on one side of the housing body, a laser source which emits lasers toward the inside of the housing body through the exit window, a plasma generation module which is located inside the housing body and generates plasma by allowing the lasers to be emitted toward a plasma gas, which flows into a laser focal area, and a radio frequency (RF) power supply module which preionizes the plasma gas before the plasma gas flows into the laser focal area.

14 Claims, 4 Drawing Sheets

EUV GENERATION DEVICE

CROSS-REFERENCE TO RELATED APPLICATION

This U.S. non-provisional patent application claims priority under 35 U.S.C. § 119 to and the benefit of Korean Patent Application No. 10-2018-0092377, filed on Aug. 8, 2018, in the Korean Intellectual Property Office (KIPO), the disclosure of which is incorporated herein by reference in its entirety.

BACKGROUND

1. Field

Example embodiments of the inventive concepts relate to an extreme ultraviolet (EUV) generation device having improved light emitting efficiency.

2. Discussion of Related Art

An extreme ultraviolet (EUV) generation device is a device which generates plasma using lasers and then generates and supplies EUV rays using the generated plasma. The EUV generation device generates the plasma by focusing lasers on a flow path through which a plasma gas flows and emitting lasers toward the plasma gas.

Meanwhile, as a size of a pattern on a semiconductor substrate decreases, a semiconductor process such as a photolithography process needs light having a wavelength shorter than those of general ultraviolet (UV) rays. Since EUV rays have a wavelength shorter than UV rays, they are applied to a light exposure process or an inspection process of a photolithography process. However, when the EUV generation device generates plasma using lasers, since the energy intensity of the generated plasma gas may be low, the intensity of the EUV rays generated therefrom may not be adequate for the light exposure process or the inspection process.

SUMMARY

Example embodiments of the inventive concepts are directed to providing an extreme ultraviolet (EUV) generation device which improves output intensity and emitting efficiency of EUV rays.

According to example embodiments, there is provided an EUV generation device including a housing including a housing body and an window formed on one side of the housing body, the housing body configured to connect to a vacuum pump such that an inside of the housing body is maintainable in a vacuum state; a laser source configured to emit lasers toward the inside of the housing body through the window; a plasma generation device inside the housing body, the plasma generation device configured to generate plasma in response to the lasers being emitted toward a plasma gas flowing into a laser focal area; and a radio frequency (RF) power supply device configured to preionize the plasma gas before the plasma gas flows into the laser focal area.

According to example embodiments, there is provided an EUV generation device configured to generate EUV rays by using a laser generation plasma method, the EUV generation device comprising: a plasma generation device configured to preionize a plasma gas to generate preionized plasma gas, and to generate plasma by emitting lasers toward the preionized plasma gas.

According to example embodiments, there is provided an EUV generation device including a laser source configured to emit lasers towards a laser focal area; a plasma generation device configured to generate plasma by directing a plasma gas to flow into the laser focal area; a radio frequency (RF) power supply device configured to preionize the plasma gas to before the plasma gas flows into the laser focal area to generate preionized plasma gas; and an electromagnet configured to focus the preionized plasma gas to the laser focal area.

BRIEF DESCRIPTION OF THE DRAWINGS

The above and other objects, features and advantages of the inventive concepts will become more apparent to those of ordinary skill in the art by describing some example embodiments thereof in detail with reference to the accompanying drawings, in which.

DETAILED DESCRIPTION

Hereinafter, extreme ultraviolet (EUV) generation devices according to example embodiments of the inventive concepts will be described.

Figure 1A:
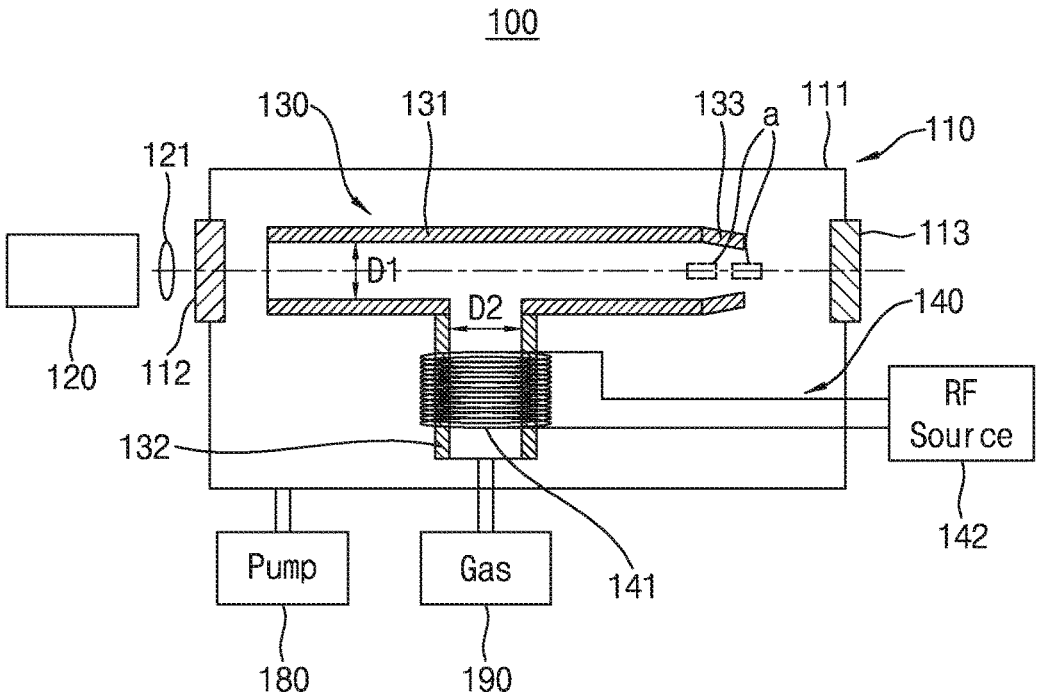
FIGS. 1A and 1B are schematic configuration diagrams illustrating an EUV generation device according to an example embodiment of the inventive concepts.
Figure 1B:
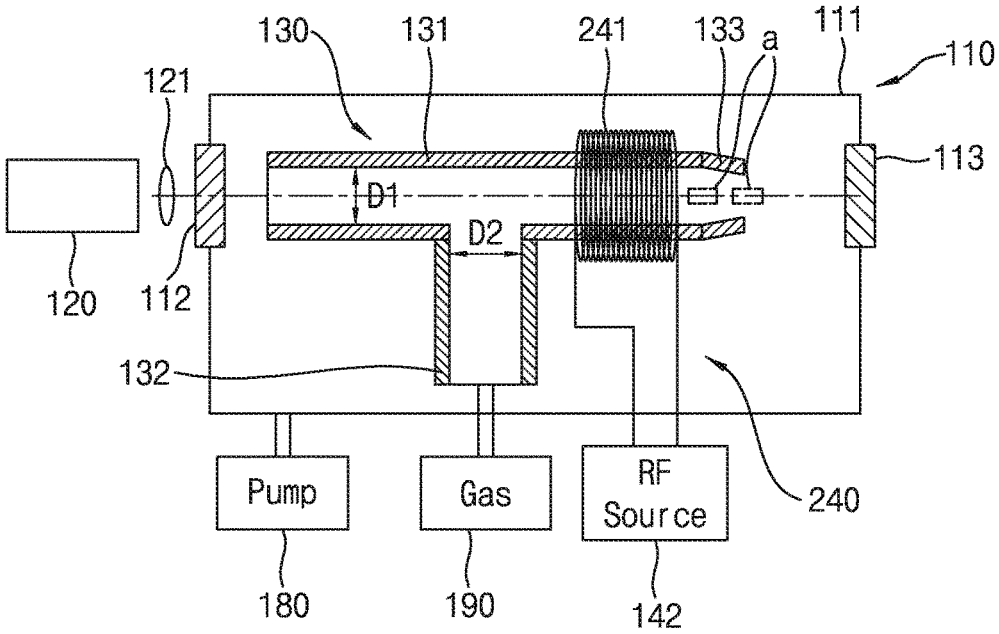

FIGS. 1A and 1B are schematic configuration diagrams illustrating an EUV generation device according to an example embodiment of the inventive concepts.

Referring to FIGS. 1A and 1B, an EUV generation device 100 according to an example embodiment of the inventive concepts, may include a housing module 110, a laser source 120, a plasma generation module 130, and a radio frequency (RF) power supply module 140. Also, the EUV generation device 100 may further include a vacuum pump 180 and a gas source 190. Meanwhile, the EUV generation device 100, although not shown in detail, may further include a condensing module (not shown) for condensing generated EUV rays and a filter module (not shown) for selecting only a wavelength necessary for the generated EUV rays.

The EUV generation device 100 is a device which emits a laser toward a plasma gas to generate plasma and then generates and supplies EUV rays using the generated plasma. The EUV generation device 100 may generate EUV rays by using a laser produced plasma (LPP) method. The EUV rays may have a wavelength of 10 nm to 0 nm. The EUV rays may have a wavelength of 10 nm to 20 nm. The EUV rays may have a wavelength of 13.5 nm.

As discussed below, in one or more example embodiments, the EUV generation device 100 may preionize a plasma gas by applying energy to the plasma gas before emitting a laser to generate the plasma. That is, the EUV generation device 100 may change the plasma gas to a preionized state by applying an electric field using an inductively coupled induced current and subsequently generate the plasma by emitting the laser to the preionized plasma gas. Here, the preionized state may refer to a state in which a plasma gas is partially or entirely ionized, that is, a state in which energy is lower than energy needed for generating plasma. Also, the preionized state may include a state in which the plasma gas is preheated.

Accordingly, since in one or more example embodiments, the EUV generation device 100 generates plasma by emitting a laser to the plasma gas in the preionized state formed by using an electric field caused by an induced current, EUV rays may be more efficiently generated. That is, the EUV generation device 100 may increase output intensity and emission efficiency of EUV rays.

The EUV generation device 100 may be applied to a variety of devices which perform a semiconductor process, such as a lithography process. For example, the EUV generation device 100 may be used for light exposure equipment in which a light exposure process is performed. In this case, the EUV generation device 100 may provide EUV rays as light exposure beams which perform a light exposure process. Also, the EUV generation device 100 may be used for an inspection device which inspects reticles.

The housing module 110 may include a housing body 111, an incident window 112, and an exit window 113. Although not shown in the drawings, the housing module 110 may further include a vacuum gage which measures an internal vacuum level of the housing body 111.

The housing body 111 is formed as a box shape with a hollow therein. The housing body 111 provides a space in which the plasma generation module 130 is accommodated. The housing body 111 provides an internal space in which EUV rays are generated. The housing body 111 may be formed of a material having thermal resistance and corrosion resistance, such as stainless steel. Since the housing body 111 is exposed to plasma at a high temperature, the housing body 111 may be formed of a material which is not damaged by the plasma at a high temperature.

The housing body 111 may be maintained in a vacuum therein. The housing body 111 may remain at an adequate vacuum level to prevent lasers or EUV rays from being absorbed into atmosphere during a process of forming EUV rays. For example, the housing body 111 may remain at a vacuum level of $10^{-3}$ torr or less. Also, the housing body 111 has an outside in contact with the atmosphere and may be combined with an optical vacuum chamber (not shown) at the exit window 113. Here, the optical vacuum chamber may be a reticle inspection chamber using generated EUV rays. Also, the housing body 111 may be located in an additional vacuum chamber.

The incident window 112 may be formed on one side of the housing body 111. The incident window 112 may provide a path through which a laser passes. Also, the incident window 112 may perform a function of separating the housing body 111 from an external environment. For example, when the housing body 111 is located in the atmosphere, the incident window 112 separates an internal space of the housing body 111 from the outside so as to maintain a vacuum state inside the housing body 111. The incident window 112 may be formed of a material which reduces (or, alternatively, minimizes) a loss of an incident laser. The incident window 112 may be formed of quartz and may separate the inside of the housing body 111 from the outside to pass a laser therethrough. Meanwhile, when the outside of the housing body 111 is in a vacuum state, the incident window 112 may be omitted. In this case, the incident window 112 may be formed as an empty hole.

The exit window 113 may be formed on the other side of the housing body 111. The exit window 113 may provide a path through which EUV rays pass. When the housing body 111 is connected to an additional optical process chamber (not shown) through the exit window 113, the exit window 113 may be formed as an empty hole. Also, the exit window 113 may be formed as an optical filter which passes only EUV rays and blocks lasers therethrough. The exit window 113 may be formed as a filter including zirconium. Also, the exit window 113 may perform a function of separating the housing body 111 from an external environment. For example, when the housing body 111 is located in the atmosphere, the exit window 113 separates an internal space of the housing body 111 from the outside so as to maintain a vacuum state inside the housing body 111. The exit window 113 may be formed of a material which reduces (or, alternatively, minimizes) a loss of EUV rays which exit therefrom. The incident window 112 and the exit window 113 may be installed in the housing body 111 at a variety of positions depending on positions of the plasma generation module 130, the RF power supply module 140, or other components in the housing body 111.

The vacuum pump may be connected to the housing body 111 and may maintain a vacuum inside the housing body 111. The vacuum pump may include a variety of vacuum pumps adequate for maintaining a vacuum level of, for example, $10^{-3}$ torr, inside the housing body 111.

The laser source 120 is a source which outputs lasers. The laser source 120 may be located outside the housing body 111 and may emit lasers toward the incident window 112. The laser source 120 may output lasers having energy sufficient for making a plasma gas enter in a plasma state. Lasers emitted by the laser source 120 may form a focal point in a laser focal area (labeled "a") located in the plasma generation module 130 and may efficiently heat the plasma gas. As discussed in more detail below, since the plasma gas is preionized by the RF power supply module 140, it is possible to more efficiently generate plasma than when lasers are emitted theretoward. The lasers may have high-intensity pulses. The lasers may be $CO_2$ lasers, NdYAG lasers, or titanium sapphire lasers. Also, the lasers may be ArF excimer lasers or KrF excimer lasers.

The laser source 120 may further include a focal lens 121. The focal lens 121 may be located between the laser source 120 and the housing body 111. The focal lens 121 may adjust a focal length of lasers emitted by the laser source 120. As the focal lens 121, a general focal lens may be used.

The plasma generation module 130 may include a laser path pipe 131 and a gas supply pipe 132. The plasma generation module 130 may further include a gas focusing pipe 133. The plasma generation module 130 forms plasma and generates EUV rays by using lasers and a plasma gas. In more detail, the plasma generation module 130 may be located in the housing body 111 and may generate plasma by emitting lasers toward a plasma gas which flows into the laser focal area "a."

The laser path pipe 131 may be formed to have a pipe shape which includes a hollow and open one and other sides.

The laser path pipe 131 may be formed as a pipe having an inner diameter which is a first diameter D1. The laser path pipe 131 may be located in the housing body 111 such that a central axis coincides with a center of the incident window 112. The laser path pipe 131 may be located in the housing body 111 such that the central axis coincides with an emission path. A laser may be incident on one side and may exit from the other side of the laser path pipe 131. In the laser path pipe 131, since a laser is emitted along the central axis, the laser focal area a may be formed at a position on the central axis. That is, in the laser path pipe 131, since an emission direction of the laser is equal to a flow direction of a plasma gas supplied by the gas supply pipe 132, the laser focal area "a" may be easily formed in a desired area. For example, the laser focal area "a," in which lasers are condensed, may be formed in the laser path pipe 131. The laser focal area a may be formed inside or outside the other side of the laser path pipe 131. Also, the laser focal area "a" may be formed at a position at which the gas supply pipe 132 is combined with the laser path pipe 131.

The laser path pipe 131 may be formed as a dielectric. The laser path pipe 131 may be formed of a transparent material such as quartz. Also, the laser path pipe 131 may be formed of alumina or a ceramic material such as zirconia.

The laser path pipe 131 may remain in a vacuum state so as to reduce (or, alternatively, prevent) a loss caused by scattering of lasers and efficiently form plasma. The laser path pipe 131 may be located inside the housing body 111 so as to maintain a vacuum state thereinside. Also, although not shown in detail in the drawings, air in the laser path pipe 131 may be discharged through an additional discharge pipe such that a vacuum state thereinside may be maintained.

A reflecting mirror (not shown), which reflects or condenses generated EUV rays, may be further included between the other side of the laser path pipe 131 and the exit window 113. In this case, a central axis of the laser path pipe 131 may not coincide with the center of the exit window 113.

The gas supply pipe 132 may be formed to have a pipe shape which includes a hollow and open top and bottom sides. The gas supply pipe 132 may be formed to have an inner diameter which is a second diameter D2. The gas supply pipe 132 may be formed of the same material as that of the laser path pipe 131. The gas supply pipe 132 may be combined with the laser path pipe 131 to be perpendicular, or to slant thereto. That is, the gas supply pipe 132 may be combined such that the central axis thereof is perpendicular to or intersects with the central axis of the laser path pipe 131 at a slant. A top of the gas supply pipe 132 may be combined with the laser path pipe 131 while passing through from an outer circumferential surface to an inner circumferential surface of the laser path pipe 131. The inside of the gas supply pipe 132 may be combined with the inside of the laser path pipe 131. The gas supply pipe 132 may be combined with the laser path pipe 131 at an intermediate position on the basis of a longitudinal direction of the laser path pipe 131. When the laser focal area "a" is formed on the other end of the laser path pipe 131, the gas supply pipe 132 may be combined with the laser path pipe 131 while tilting toward the other end. That is, the gas supply pipe 132 may be combined with the laser path pipe 131 while the bottom side rotates about the top side, combined with the laser path pipe 131, toward the one side of the laser path pipe 131. In this case, the plasma gas supplied by the gas supply pipe 132 may more efficiently flow toward the other side of the laser path pipe 131.

The gas supply pipe 132 may supply the plasma gas to the inside of the laser path pipe 131. The second diameter of the gas supply pipe 132 may be greater than the first diameter of the laser path pipe 131. The second diameter may be 1.1 to 2.0 times the first diameter. Accordingly, an amount of the plasma gas supplied by the gas supply pipe 132 is larger than an amount of the gas which flows in the laser path pipe 131. Also, the plasma gas may flow throughout the laser path pipe 131 at a uniform density.

The gas focusing pipe 133 may have a pipe shape which is open from a first side to a second side and has an inner diameter which decreases from the first side toward the second side. The gas focusing pipe 133 may be integrally formed with the laser path pipe 131. The second end of the gas focusing pipe 133 may have an inner diameter smaller than an inner diameter of the gas supply pipe 132. The first end of the gas focusing pipe 133 may be combined with the other end of the laser path pipe 131. The gas focusing pipe 133 focuses a plasma gas, which flows in from the laser path pipe 131, while allowing the plasma gas to flow from one side to the other side. That is, the gas focusing pipe 133 may increase density of the plasma gas, which flows thereinto. Since the inner diameter of the second end of the gas focusing pipe 133 is formed to be smaller than the inner diameter of the laser path pipe 131, the plasma gas may be more efficiently focused. When the gas focusing pipe 133 is formed, the laser focal area "a" may be formed inside or outside the gas focusing pipe 133 instead of the inside of the laser path pipe 131. The laser focal area "a" may be formed inside or outside the second end of the gas focusing pipe 133. The gas focusing pipe 133 may increase efficiency of forming plasma by increasing the density of the plasma gas in the laser focal area "a." Meanwhile, when it is possible to focus the plasma gas due to the inner diameter of the laser path pipe 131 being adequately small, the gas focusing pipe 133 may be omitted.

The RF power supply module 140 may include an RF coil 141 and an RF power source 142. The RF power supply module 140 may preionize the plasma gas before the plasma gas flows into the laser focal area a.

The RF coil 141 may be wound at least once on an outer circumferential surface of the gas supply pipe 132. The RF coil 141 may be wound an adequate number of times for preionizing the plasma gas, which flows in the gas supply pipe 132, or for supplying energy for plasma generation. The RF coil 141 may generate an inductive-coupling type induced current and may apply an electric field to the plasma gas.

The RF power source 142 may be electrically connected to the RF coil 141. The RF power source 142 may supply power for preionization of the plasma gas to the RF coil 141. The RF power source 142 may supply power having a frequency of, for example, 13.5 MHz to 80 MHz.

The vacuum pump 180 may be connected to the housing body 111 and may maintain a vacuum inside the housing body 111. The vacuum pump may be connected to the laser path pipe 131 and may maintain a vacuum inside the laser path pipe 131. An adequate vacuum pump may be used according to a necessary vacuum level.

The gas source 190 may be connected to the gas supply pipe 132 and may supply a plasma gas to the gas supply pipe 132. Ne, He, Ar, or Xe gas may be used as the plasma gas.

As illustrated in FIG. 1A, in some example embodiments, the RF coil 141 may be wound on the outer circumferential surface of the gas supply pipe 132. However, as discussed below with reference to FIG. 1B to FIG. 7, example embodiments are not limited thereto.

Referring to FIG. 1B, in an EUV generation device 200 according to another example embodiment of the inventive concepts, an RF coil 241 of the RF power supply module 240 may be wound on the other side of the laser path pipe 131. That is, the RF coil 241 may be wound on the outer circumferential surface of the laser path pipe 131 between the other end of the laser path pipe 131 and the gas focusing pipe 133. The RF coil 241 may preionize the plasma gas at a position adjacent to the laser focal area a. Accordingly, the EUV generation device 200 may more efficiently form plasma so as to increase light emission efficiency.

Meanwhile, in the EUV generation device 200, although not shown in detail in the drawing, the RF coil 141 may even be wound on a position which is the same as that in FIG. 1A.

Hereinafter, EUV generation devices according to other example embodiments of the inventive concepts will be described.

Figure 2:
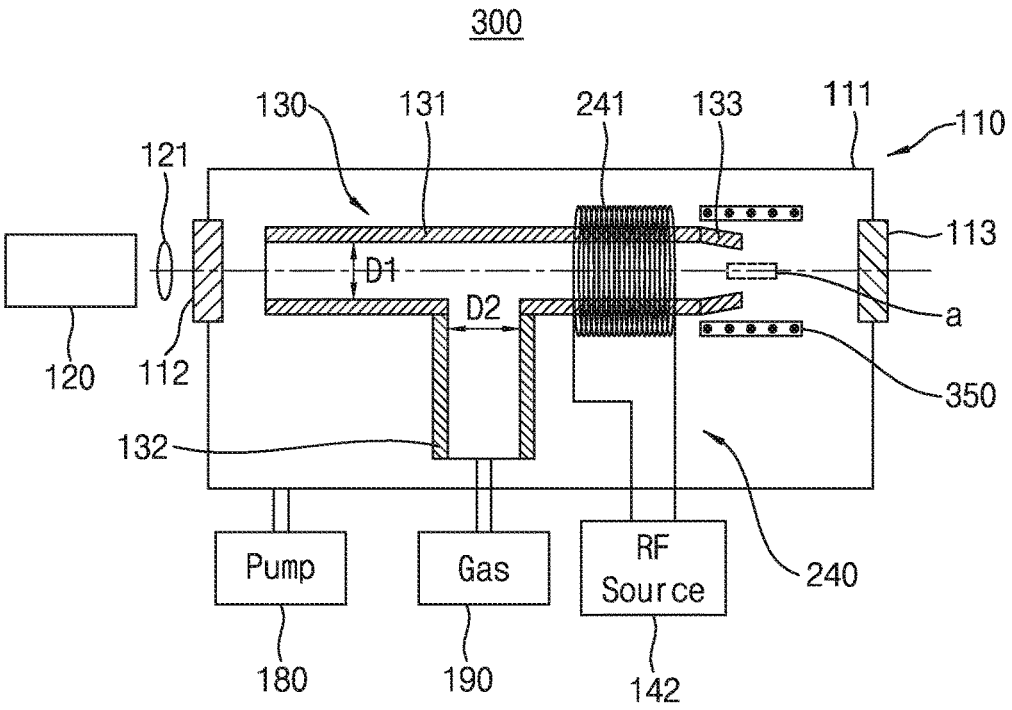
FIG. 2 is a configuration diagram of an EUV generation device according to another example embodiment of the inventive concepts.

FIG. 2 is a configuration diagram of an EUV generation device according to another example embodiment of the inventive concept.

Referring to FIG. 2, an EUV generation device 300 according to another example embodiment of the inventive concepts may include the housing module 110, the laser source 120, the plasma generation module 130, an RF power supply module 240, and an electromagnet 350.

In comparison to the EUV generation devices 100 and 200 shown in FIGS. 1A and 1B, the EUV generation device 300 may be equally or similarly formed except for the electromagnet 350 also being included therein. Accordingly, hereinafter, the electromagnet 350 of the EUV generation device 300 will be mainly described. Also, in describing the EUV generation device 300, components equal or similar to those of the EUV generation devices 100 and 200 shown in FIGS. 1A and 1B will be referred to with the same reference numerals and a detailed description thereof will be omitted. Meanwhile, it is the same in other following example embodiments.

The electromagnet 350 may have a ring shape formed of a wound coil. The electromagnet 350, although not shown in detail, may include an annular case, an annular magnet core located in the case, and a coil wound on the magnet core. The coil may be annularly wound on the magnet core. The electromagnet 350 may have an inner diameter corresponding to or greater than an outer diameter of the laser path pipe 131. The electromagnet 350 may have an adequate length for focusing a plasma gas. The length of the electromagnet 350 may be determined empirically. The electromagnet 350 may be located such that one side thereof comes into contact with or partially overlaps the other side of the laser path pipe 131.

The electromagnet 350 may be located such that a central axis thereof coincides with the central axis of the laser path pipe 131. The laser focal area "a" may be located at the central axis of the electromagnet 350. The electromagnet 350 may receive power from an additional external power source (not shown) and may generate a magnetic field. However, example embodiments are not limited thereto, and the electromagnet 350 may share a power source with other components of the EUV generation device 300. The electromagnet 350 may apply a magnetic force to an area including the laser focal area "a." That is, the electromagnet 350 may apply a magnetic force to a plasma gas which flows into the laser focal area a. The electromagnet 350 may focus a preionized plasma gas, which flows in from the other side of the laser path pipe 131, in the area including the laser focal area a by using a magnetic force. That is, the electromagnet 350 may increase density of the plasma gas in the area including the laser focal area "a." Since the plasma gas changes to an ionized state in the laser path pipe 131 or the gas supply pipe 132, the plasma gas may be focused by a magnetic force of the magnetic field.

When the gas focusing pipe 133 is combined with the other side of the laser path pipe 131, the electromagnet 350 may be located to surround at least an outer circumferential surface of the gas focusing pipe 133. The electromagnet 350 may have a length longer than that of the gas focusing pipe 133 and may be combined to surround an area including the outer circumferential surface of the gas focusing pipe 133. Also, the electromagnet 350 may have an inner diameter corresponding to the inner diameter of the gas focusing pipe 133. Accordingly, one side of the electromagnet 350 may come into contact with and be combined with the second end of the gas focusing pipe 133. The laser focal area "a" may be formed inside the gas focusing pipe 133 or the electromagnet 350.

Hereinafter, an EUV generation device according to another example embodiment of the inventive concepts will be described.

Figure 3:
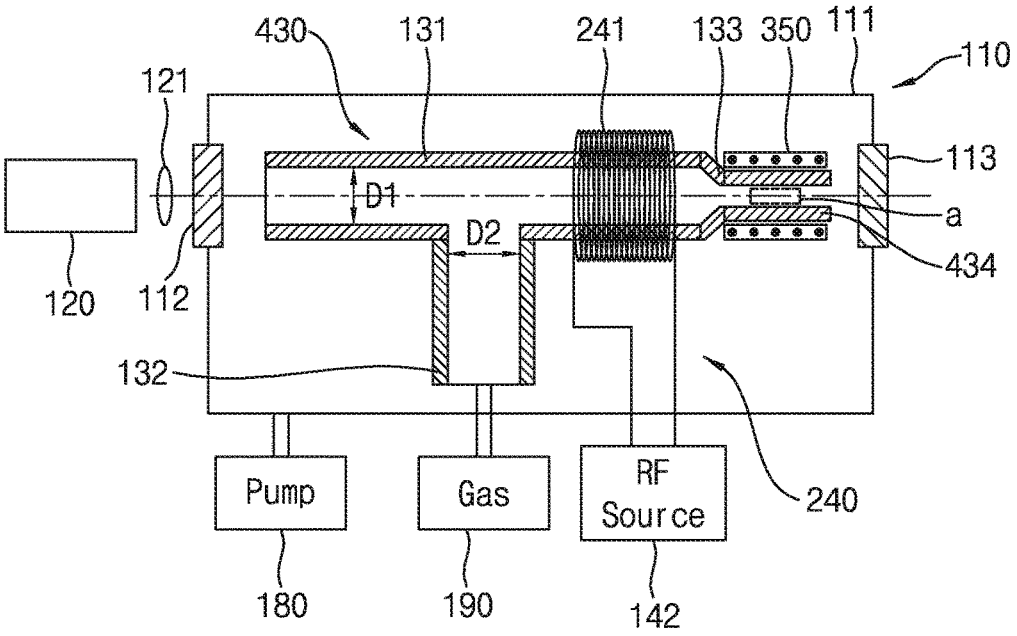
FIG. 3 is a configuration diagram of an EUV generation device according to another example embodiment of the inventive concepts.

FIG. 3 is a configuration diagram of an EUV generation device according to another example embodiment of the inventive concepts.

Referring to FIG. 3, an EUV generation device 400 according to another example embodiment of the inventive concepts may include the housing module 110, the laser source 120, a plasma generation module 430, the RF power supply module 240, and the electromagnet 350.

The plasma generation module 430 may include the laser path pipe 131, the gas supply pipe 132, the gas focusing pipe 133, and a gas induction pipe 434.

The gas induction pipe 434 may have an inner diameter corresponding to an inner diameter of the second end of the gas focusing pipe 133. The gas induction pipe 434 may be integrally formed with the laser path pipe 131 and the gas focusing pipe 133. The gas induction pipe 434 may have an outer diameter corresponding to an inner diameter of the electromagnet 350. The gas induction pipe 434 may have at least a length corresponding to a length of the electromagnet 350. One side of the gas induction pipe 434 may be combined with the second end of the gas focusing pipe 133 and may extend toward an inside of the electromagnet 350. The gas induction pipe 434 may induce a plasma gas, which flows in from the gas focusing pipe 133, to flow inside the electromagnet 350.

Since an inner circumferential surface of the electromagnet 350 comes into contact with or is located to be adjacent to an outer circumferential surface of the gas induction pipe 434, a distance between the electromagnet 350 and the plasma gas may be reduced. Accordingly, the electromagnet 350 may more efficiently focus the plasma gas by increasing a magnetic force toward the plasma gas.

Hereinafter, an EUV generation device according to another example embodiment of the inventive concepts will be described.

Figure 4:
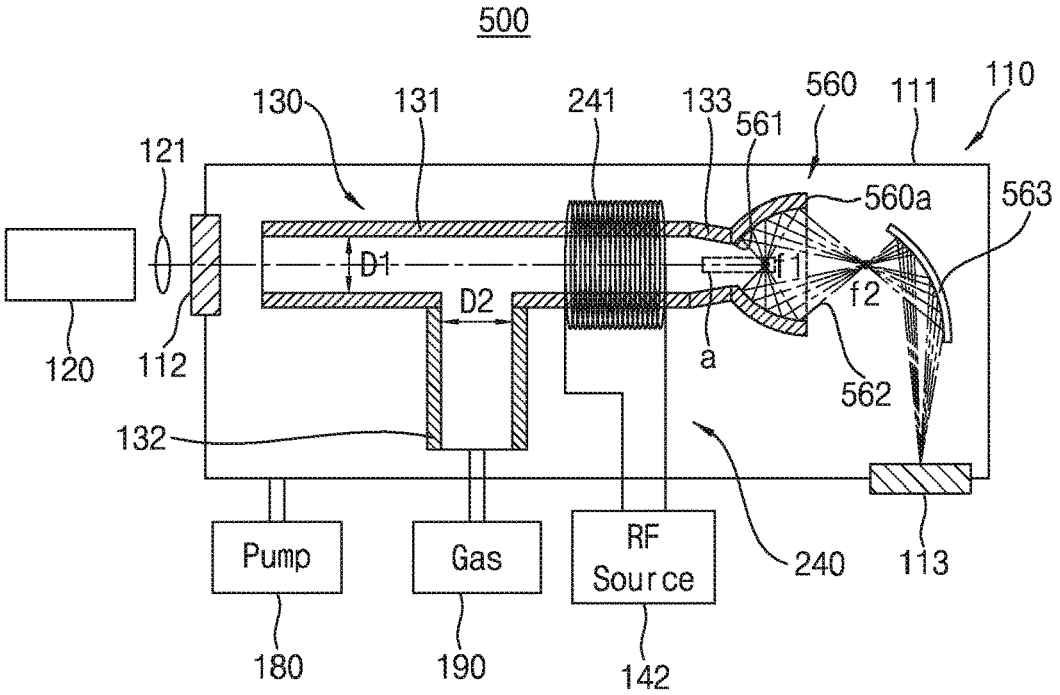
FIG. 4 is a configuration diagram of an EUV generation device according to another example embodiment of the inventive concepts.

FIG. 4 is a configuration diagram of an EUV generation device according to another example embodiment of the inventive concepts.

Referring to FIG. 4, an EUV generation device 500 according to another example embodiment of the inventive concepts may include the housing module 110, the laser source 120, the plasma generation module 130, the RF power supply module 240, and a condensing module 560.

The condensing module 560 may include a laser incident hole 561 and an EUV exit hole 562. Also, the condensing module 560 may further include a reflecting mirror 563. Meanwhile, the condensing module 560 may further include a filter (not shown) which filters focused EUV rays and an optical device (not shown) for changing a path of EUV rays. Since the condensing module 560 focuses and emits EUV rays generated by plasma, it is possible to increase efficiency of supplying EUV rays.

The condensing module 560 may be formed to have a semi-elliptical sphere shape formed by cutting an elliptical sphere along a cross section 560*a* perpendicular to a central axis. Here, the central axis may be an axis which connects a first focal point f1 to a second focal point f2 of the elliptical sphere. Also, the first focal point f1 may be a focal point located on one side of an ellipse formed when the elliptical sphere, which forms the condensing module 560, is cut in a major axis direction. The second focal point f2 may be a focal point located on the other side of the ellipse. The semi-elliptical sphere may include the first focal point f1 located on one side and the virtual second focal point f2 located on the other side. Also, the cross section may be a surface located at an intermediate position of the central axis or a position spaced apart from the intermediate position. Also, the condensing module 560 may be formed as an elliptical mirror or an elliptical reflecting mirror. The condensing module 560 may be formed of a transparent material. For example, the condensing module 560 may be formed of a quartz material. Also, the condensing module 560 may include an Mo—Si multilayer film formed on an inner reflecting surface to efficiently reflect EUV rays. Here, the Mo—Si multilayer film may be a film formed by alternately stacking an Mo layer and an SiC layer.

The laser incident hole 561 may be formed at a center of an inner circumferential surface of the semi-elliptical sphere. That is, the laser incident hole 561 may be formed at a point at which a line, which connects the center of the cross section to the first focal point f1 of the ellipse, meets the inner circumferential surface of the semi-elliptical sphere. The laser incident hole 561 may be formed to have an adequate diameter necessary to allow a laser to pass therethrough. The laser incident hole 561 may be formed as an aperture formed in a general reflecting mirror. The EUV exit hole 562 may be formed on a side opposite to the laser incident hole 561. The EUV exit hole 562 may be formed at a position at which the semi-elliptical sphere is opened due to the cross section. The EUV exit hole 562 may output generated EUV rays to the outside.

The condensing module 560 may be combined such that the laser incident hole 561 communicates with the laser path pipe 131 or the gas focusing pipe 133. The laser incident hole 561 may be directly connected to the laser path pipe 131 or the gas focusing pipe 133. The laser incident hole 561 allows lasers to be emitted toward an inside of the condensing module 560 through the laser path pipe 131. The condensing module 560 may include the laser focal area "a" thereinside. In the condensing module 560, an area including the first focal point f1 may be formed as the laser focal area "a." The laser incident hole 561 allows lasers to be emitted toward the laser focal area a located inside the condensing module 560. Also, the laser incident hole 561 may allow an ionized plasma gas to flow into the condensing module 560.

The plasma gas and lasers may form plasma in the laser focal area "a" of the condensing module 560 and generate EUV rays. The EUV rays generated using the plasma may be emitted in all directions. The condensing module 560 may condense the EUV rays emitted in a variety of directions and emit the condensed EUV rays in a direction opposite to the laser focal area "a". Here, the EUV rays emitted by the condensing module 560 may pass through a reflection focal point located on a side of the central axis of the ellipse opposite to the laser focal area "a." Here, the reflection focal point may be the second focal point f2 of the ellipse. The EUV rays condensed by the condensing module 560 may pass through the reflection focal point and may be emitted in an opposite direction.

The reflecting mirror 563 may be installed at a position adjacent to the reflection focal point and may emit EUV rays in a particular direction. The reflecting mirror 563 may allow EUV rays to exit downward. Here, the exit window 113 may be located on a bottom surface of the housing body 111. As the reflecting mirror 563, a general reflecting mirror used for reflecting and condensing EUV rays may be used. Also, the reflecting mirror 563 may be formed as a shape capable of efficiently reflecting and condensing EUV rays. The reflecting mirror 563 may be formed as an elliptical mirror or an elliptical reflecting mirror. Also, the reflecting mirror 563 may include an Mo—Si multilayer film formed on an inner reflecting surface to efficiently reflect EUV rays.

Hereinafter, an EUV generation device according to another example embodiment of the inventive concepts will be described.

Figure 5:
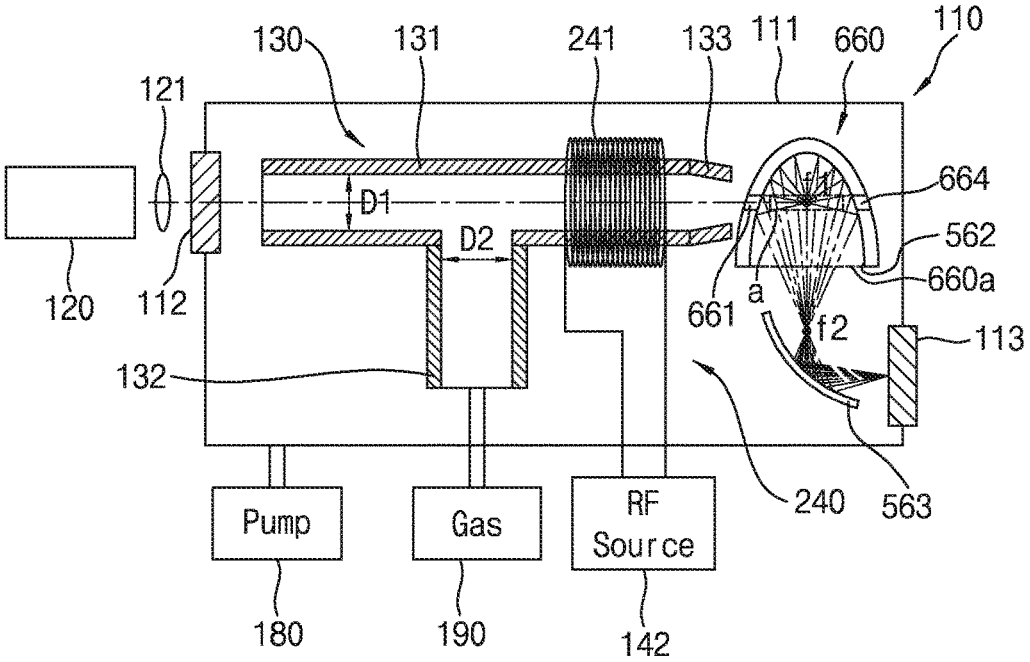
FIG. 5 is a configuration diagram of an EUV generation device according to another example embodiment of the inventive concepts.

FIG. 5 is a configuration diagram of an EUV generation device according to another example embodiment of the inventive concept.

Referring to FIG. 5, an EUV generation device 600 according to another example embodiment of the inventive concepts may include the housing module 110, the laser source 120, the plasma generation module 130, the RF power supply module 240, and a condensing module 660.

The condensing module 660 may include a laser incident hole 661 and the EUV exit hole 562. Also, the condensing module 660 may further include the reflecting mirror 563. Also, the condensing module 660 may further include a laser exit hole 664.

The condensing module 660 may be formed to have a semi-elliptical sphere shape formed by cutting an elliptical sphere along a cross section 660*a* perpendicular to a central axis thereof. The semi-elliptical sphere may include a first focal point f1 located on one side and a virtual second focal point f2 located on the other side. The condensing module 660, like the condensing module 560 according to the example embodiment shown in FIG. 4, may be formed of sapphire and may include an Mo—Si multilayer film on a reflecting surface.

The laser incident hole 661 may be formed at a point at which a line, which is parallel to the cross section and passes through the first focal point f1, meets an inner circumferential surface of the elliptical sphere. That is, the laser incident hole 661 may be formed at a position perpendicular to a central axis of the semi-elliptical sphere. The laser incident hole 661 may be formed to have an adequate diameter necessary for allowing a laser to pass therethrough. The EUV exit hole 562 may be formed at a position which meets the laser incident hole 551 at a right angle. That is, the EUV exit hole 562 may be formed at a position at which the semi-elliptical sphere is opened by the cross section. The EUV exit hole 562 may output generated EUV rays to the outside.

The condensing module 660 may be combined such that the laser incident hole 661 communicates with the laser path pipe 131 or the gas focusing pipe 133. The laser incident hole 661 may be directly connected to the laser path pipe 131 or the gas focusing pipe 133. The laser incident hole 661 allows lasers to be emitted toward an inside of the condensing module 660 through the laser path pipe 131. The laser incident hole 661 may allow an ionized plasma gas to flow into the condensing module 660.

The condensing module 660 may receive lasers which are incident in a horizontal direction and emit EUV rays in a downward direction. Accordingly, in the condensing module 660, an incident direction of lasers and an exit direction of EUV rays may meet at a right angle.

The reflecting mirror 563 may reflect and emit EUV rays toward the exit window 113. The reflecting mirror 563 may allow EUV rays to exit in a horizontal direction. Here, the exit window 113 may be located on a side surface of the housing body 111.

The laser exit hole 664 may allow lasers which pass through the laser focal area a to exit from the condensing module 660. A laser dump (not shown) is installed outside the laser exit hole 664 so as to convert energy of lasers which exit therefrom into heat and dissipate the heat.

Figure 6:
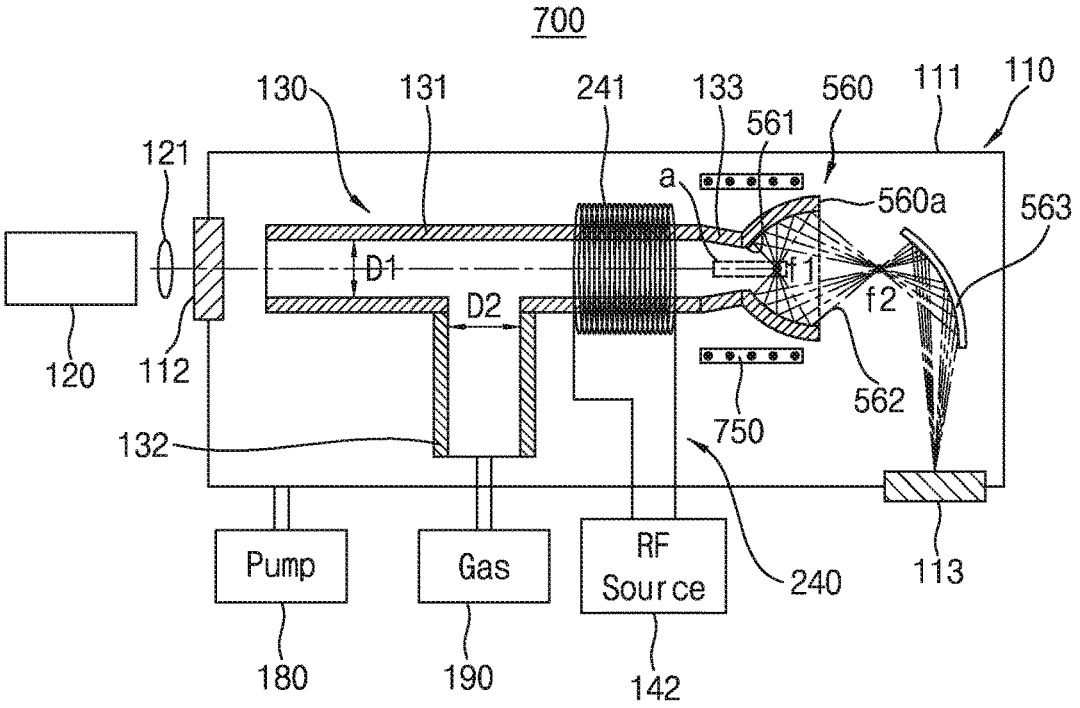
FIG. 6 is a configuration diagram of an EUV generation device according to another example embodiment of the inventive concepts.

FIG. 6 is a configuration diagram of an EUV generation device according to another example embodiment of the inventive concepts.

Referring to FIG. 6, an EUV generation device 700 according to another example embodiment of the inventive concepts may include the housing module 110, the laser source 120, the plasma generation module 130, the RF power supply module 240, an electromagnet 750, and the condensing module 560.

The electromagnet 750 may be formed to have an annular shape in which one side and the other side have the same inner diameters. The electromagnet 750 may be formed to have an inner diameter greater than an outer diameter of the cross section of the condensing module 560. The electromagnet 750 may be located outside the condensing module 560 to surround an area including the laser focal area a. The electromagnet 750 may have an adequate length for focusing a plasma gas in the laser focal area "a." For example, the electromagnet 750 may be located such that one side thereof comes into contact with or partially overlaps the other side of the laser path pipe 131 or the gas focusing pipe 133. Also, the other side of the electromagnet 750 may be located on the other side rather than the laser focal area "a" of the condensing module 560. Accordingly, the electromagnet 750 may focus a plasma gas, which flows into the condensing module 560 through the laser path pipe 131 or the gas focusing pipe 133, in the laser focal area "a."

Figure 7:
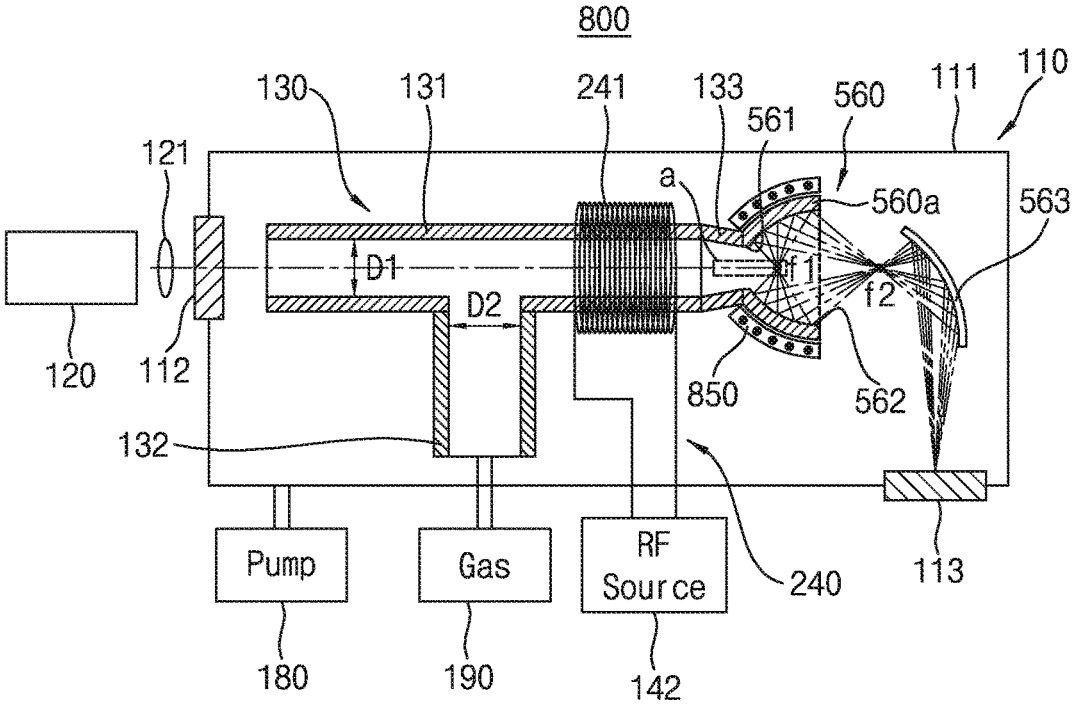
FIG. 7 is a configuration diagram of an EUV generation device according to another example embodiment of the inventive concepts.

FIG. 7 is a configuration diagram of an EUV generation device according to another example embodiment of the inventive concepts.

Referring to FIG. 7, an EUV generation device 800 according to another example embodiment of the inventive concepts may include the housing module 110, the laser source 120, the plasma generation module 130, the RF power supply module 240, an electromagnet 850, and the condensing module 560.

The electromagnet 850 may be formed to have an annular shape and may have an inner circumferential surface having a shape corresponding to that of an outer circumferential surface of the condensing module 560. That is, the electromagnet 850 may be formed to have a shape in which an inner diameter increases from one side toward the other side. The electromagnet 850 may have an adequate length for focusing a plasma gas in the laser focal area "a." For example, the electromagnet 850 may be located such that one side thereof comes into contact with or partially overlaps the other side of the laser path pipe 131 or the gas focusing pipe 133. Also, the other side of the electromagnet 850 may be located on the other side rather than the laser focal area "a" of the condensing module 560. Accordingly, since the electromagnet 850 is installed to be adjacent to the condensing module 560, it is possible to efficiently focus a plasma gas which flows into the condensing module 560.

According to the example embodiments of the inventive concepts, an EUV generation device which improves output intensity and emission efficiency of EUV rays can be realized.

According to one or more example embodiments, while not illustrated, the EUV generation devices 100 to 800 may further include a controller (not illustrated) configured to control the laser source, vacuum pump, gas source, RF power source and/or electromagnet such that the EUV generation devices 100 to 800 preionized the plasma gas supplied thereto and generates plasma by emitting a laser to the plasma gas in the preionized state such that the EUV generation devices 100-800 may increase output intensity and emission efficiency of EUV rays.

In some example embodiments, the controller implemented using hardware, a combination of hardware and software, or a non-transitory storage medium storing software that is executable to perform the functions of the same.

Hardware may be implemented using processing circuity such as, but not limited to, one or more processors, one or more Central Processing Units (CPUs), one or more controllers, one or more arithmetic logic units (ALUs), one or more digital signal processors (DSPs), one or more microcomputers, one or more field programmable gate arrays (FPGAs), one or more System-on-Chips (SoCs), one or more programmable logic units (PLUs), one or more microprocessors, one or more Application Specific Integrated Circuits (ASICs), or any other device or devices capable of responding to and executing instructions in a defined manner.

Software may include a computer program, program code, instructions, or some combination thereof, for independently or collectively instructing or configuring a hardware device to operate as desired. The computer program and/or program code may include program or computer-readable instructions, software components, software modules, data files, data structures, etc., capable of being implemented by one or more hardware devices, such as one or more of the hardware devices mentioned above. Examples of program code include both machine code produced by a compiler and higher level program code that is executed using an interpreter.

For example, when a hardware device is a computer processing device (e.g., one or more processors, CPUs, controllers, ALUs, DSPs, microcomputers, microprocessors, etc.), the computer processing device may be configured to carry out program code by performing arithmetical, logical, and input/output operations, according to the program code. Once the program code is loaded into a computer processing device, the computer processing device may be programmed to perform the program code, thereby transforming the computer processing device into a special purpose computer processing device. In a more specific example, when the program code is loaded into a processor, the processor becomes programmed to perform the program code and operations corresponding thereto, thereby transforming the processor into a special purpose processor. In another example, the hardware device may be an integrated circuit customized into special purpose processing circuitry (e.g., an ASIC).

A hardware device, such as a computer processing device, may run an operating system (OS) and one or more software applications that run on the OS. The computer processing device also may access, store, manipulate, process, and create data in response to execution of the software. For simplicity, one or more example embodiments may be illustrated as one computer processing device; however, one skilled in the art will appreciate that a hardware device may include multiple processing elements and multiple types of processing elements. For example, a hardware device may include multiple processors or a processor and a controller. In addition, other processing configurations are possible, such as parallel processors.

Storage media may also include one or more storage devices at units and/or devices according to one or more example embodiments. The one or more storage devices may be tangible or non-transitory computer-readable storage media, such as random access memory (RAM), read only memory (ROM), a permanent mass storage device (such as a disk drive), and/or any other like data storage mechanism capable of storing and recording data. The one or more storage devices may be configured to store computer programs, program code, instructions, or some combination thereof, for one or more operating systems and/or for implementing the example embodiments described herein. The computer programs, program code, instructions, or some combination thereof, may also be loaded from a separate computer readable storage medium into the one or more storage devices and/or one or more computer processing devices using a drive mechanism. Such separate computer readable storage medium may include a Universal Serial Bus (USB) flash drive, a memory stick, a Blu-ray/DVD/CD-ROM drive, a memory card, and/or other like computer readable storage media. The computer programs, program code, instructions, or some combination thereof, may be loaded into the one or more storage devices and/or the one or more computer processing devices from a remote data storage device via a network interface, rather than via a computer readable storage medium. Additionally, the computer programs, program code, instructions, or some combination thereof, may be loaded into the one or more storage devices and/or the one or more processors from a remote computing system that is configured to transfer and/or distribute the computer programs, program code, instructions, or some combination thereof, over a network. The remote computing system may transfer and/or distribute the computer programs, program code, instructions, or some combination thereof, via a wired interface, an air interface, and/or any other like medium.

The one or more hardware devices, the storage media, the computer programs, program code, instructions, or some combination thereof, may be specially designed and constructed for the purposes of the example embodiments, or they may be known devices that are altered and/or modified for the purposes of example embodiments.

While example embodiments of the inventive concepts have been described with reference to the accompanying drawings, it should be understood by those skilled in the art that various modifications may be made without departing from the scope of the inventive concepts. Therefore, the above-described example embodiments should be considered in a descriptive sense only and not for purposes of limitation.

What is claimed is:

1. An extreme ultraviolet (EUV) generation device comprising:

a housing including a housing body and a window formed on one side of the housing body, the housing body configured to connect to a vacuum pump such that an inside of the housing body is maintainable in a vacuum state;

a laser source configured to emit lasers toward the inside of the housing body through the window;

a plasma generation device inside the housing body, the plasma generation device configured to generate plasma in response to the lasers being emitted toward a plasma gas flowing into a laser focal area, the plasma generation device including a laser path pipe, a gas supply pipe connected to the laser path pipe, and a gas focusing pipe, the laser path pipe having a first end, a second end and a central axis that coincides with an emission path of the lasers emitted into the laser path pipe from the first end thereof such that the laser focal area is closer to the second end of the laser path pipe, the gas supply pipe configured to supply the plasma gas to an inside of the laser path pipe, and the gas focusing pipe having a first end connected to the second end of the laser path pipe, the gas focusing pipe being shaped such that an inner diameter of the gas focusing pipe decreases from the first end toward a second end thereof, the laser focal area being closer to the second end of the gas focusing pipe than the first end of the gas focusing pipe, wherein an inner diameter of the laser path pipe is smaller than the inner diameter of the first end of the gas supply pipe and larger than an inner diameter of the second end of the gas focusing pipe; and a radio frequency (RF) power supply device configured to preionize the plasma gas before the plasma gas flows into the laser focal area, the RF power supply device including an RF coil and an RF power source configured to supply power to the RF coil, the RF coil wound on one or more of (i) an outer circumferential surface of the gas supply pipe or (ii) an outer circumferential surface of the laser path pipe downstream of a junction between the gas supply pipe and the laser path pipe.

2. The EUV generation device of claim 1, further comprising:

an electromagnet including an annularly wound coil having a central axis thereof that coincides with the central axis of the laser path pipe, wherein the laser focal area is on the central axis of the electromagnet.

3. The EUV generation device of claim 2, wherein the plasma generation device further comprises:

a gas focusing pipe having a first end connected to the second end of the laser path pipe, the gas focusing pipe being shaped such that an inner diameter of the gas focusing pipe decreases from the first end toward a second end thereof; and a gas induction pipe connected to the second end of the gas focusing pipe and extending toward an inside of the electromagnet.

4. The EUV generation device of claim 1, further comprising:

a condenser downstream of the laser path pipe, the condenser having a shape of semi-elliptical sphere with a laser incident hole included therein such that the EUV generation device is configured to transfer the plasma gas from the laser path pipe to the condenser via the laser incident hole, wherein the laser focal area is in an area in the condenser that includes a first focal point of the semi-elliptical sphere.

5. The EUV generation device of claim 4, further comprising:

an electromagnet including an annularly wound coil having a central axis thereof that coincides with the central axis of the laser path pipe, the electromagnet being outside the condenser such that the electromagnet surrounds the first focal point and the laser focal area is on the central axis of the electromagnet.

6. The EUV generation device of claim 5, wherein the electromagnet has an annular shape such that both ends thereof have a same inner diameter.

7. The EUV generation device of claim 5, wherein the electromagnet has an inner circumferential surface having a shape corresponding to that of an outer circumferential surface of the condenser.

8. The EUV generation device of claim 1, further comprising:

a condenser downstream of the laser path pipe, the condenser having a shape of a semi-elliptical sphere with a laser incident hole included therein such that the EUV generation device is configured to transfer the plasma gas from the laser path pipe to the condenser via the laser incident hole, the laser incident hole being at a point of the semi-elliptical sphere at which a line, which is parallel to a cross section of the semi-elliptical sphere and passes through a first focal point of the semi-elliptical sphere, meets an inner circumferential surface of the semi-elliptical sphere, wherein the laser focal area is in an area in the condenser that includes the first focal point.

9. The EUV generation device of claim 1, wherein the plasma generation device is configured to generate EUV rays via a laser generation plasma method such that the EUV rays generated thereby have a wavelength between 10 nm to 20 nm.

10. An extreme ultraviolet (EUV) generation device configured to generate EUV rays by using a laser generation plasma method, the EUV generation device comprising:

a plasma generation device configured to preionize a plasma gas to generate preionized plasma gas, and to generate plasma by emitting lasers toward the preionized plasma gas, the plasma generation device including a laser path pipe, a gas supply pipe connected to the laser path pipe, and a gas focusing pipe, the laser path pipe having a first end, a second end and a central axis that coincides with an emission path of the lasers emitted into the laser path pipe from the first end thereof such that the laser focal area is closer to the second end of the laser path pipe, the gas supply pipe configured to supply the plasma gas to an inside of the laser path pipe, and the gas focusing pipe having a first end connected to the second end of the laser path pipe, the gas focusing pipe being shaped such that an inner diameter of the gas focusing pipe decreases from the first end toward a second end thereof, the laser focal area being closer to the second end of the gas focusing pipe than the first end of the gas focusing pipe, wherein an inner diameter of the laser path pipe is smaller than the inner diameter of the first end of the gas supply pipe and larger than an inner diameter of the second end of the gas focusing pipe; and a radio frequency (RF) power supply device configured to preionize the plasma gas before the plasma gas flows into the laser focal area, the RF power supply device including an RF coil and an RF power source configured to supply power to the RF coil, the RF coil wound on one or more of (i) an outer circumferential surface of the gas supply pipe or (ii) an outer circumferential surface of the laser path pipe downstream of a junction between the gas supply pipe and the laser path pipe.

11. The EUV generation device of claim 10, further comprising:

an electromagnet including an annularly wound coil having a central axis thereof coincides with a central axis of the laser path pipe, wherein the laser focal area is on the central axis of the electromagnet.

12. The EUV generation device of claim 10, further comprising:

a condenser downstream of the laser path pipe, the condenser having a shape of a semi-elliptical sphere with a laser incident hole included therein such that the EUV generation device is configured to transfer the plasma gas from the laser path pipe to the condenser via the laser incident hole, the laser incident hole being at a point of the semi-elliptical sphere at which a line, which is parallel to a cross section of the semi-elliptical sphere and passes through a first focal point of the semi-elliptical sphere, meets an inner circumferential surface of the semi-elliptical sphere, wherein the laser focal area is in an area in the condenser that includes the first focal point.

13. An extreme ultraviolet (EUV) generation device comprising:

a laser source configured to emit lasers towards a laser focal area;

a plasma generation device configured to generate plasma by directing a plasma gas to flow into the laser focal area, the plasma generation device including a laser path pipe, a gas supply pipe connected to the laser path pipe, and a gas focusing pipe, the laser path pipe having a first end, a second end and a central axis that coincides with an emission path of the lasers emitted into the laser path pipe from the first end thereof such that the laser focal area is closer to the second end of the laser path pipe, the gas supply pipe configured to supply the plasma gas to an inside of the laser path pipe, and the gas focusing pipe having a first end connected to the second end of the laser path pipe, the gas focusing pipe being shaped such that an inner diameter of the gas focusing pipe decreases from the first end toward a second end thereof, the laser focal area being closer to the second end of the gas focusing pipe than the first end of the gas focusing pipe, wherein an inner diameter of the laser path pipe is smaller than the inner diameter of the first end of the gas supply pipe and larger than an inner diameter of the second end of the gas focusing pipe;

a radio frequency (RF) power supply device configured to preionize the plasma gas to before the plasma gas flows into the laser focal area to generate preionized plasma gas, the RF power supply device including an RF coil and an RF power source configured to supply power to the RF coil, the RF coil wound on one or more of (i) an outer circumferential surface of the gas supply pipe or (ii) an outer circumferential surface of the laser path pipe downstream of a junction between the gas supply pipe and the laser path pipe; and an electromagnet configured to focus the preionized plasma gas to the laser focal area.

14. The EUV generation device of claim 13, wherein the electromagnet outside the gas focusing pipe such that the electromagnet surrounds the gas focusing pipe.

* * * * *